US007060164B2

(12) United States Patent
Nogueira, Jr.

(10) Patent No.: US 7,060,164 B2
(45) Date of Patent: Jun. 13, 2006

(54) DOUBLE-FIRED PROCESSING FURNACE

(75) Inventor: Laudemiro Nogueira, Jr., Rio de Janeiro (BR)

(73) Assignee: Petroleo Brasileiro S.A., Petrobras (BR)

( * ) Notice: Subject to any disclaimer, the term of this patent is extended or adjusted under 35 U.S.C. 154(b) by 313 days.

(21) Appl. No.: 10/414,113

(22) Filed: Apr. 16, 2003

(65) Prior Publication Data

US 2004/0124075 A1 Jul. 1, 2004

(30) Foreign Application Priority Data

Dec. 30, 2002 (BR) ..... 0205207

(51) Int. Cl.
*F22B 37/24* (2006.01)
*C10B 3/02* (2006.01)

(52) U.S. Cl. ..... 202/124; 202/241; 422/198; 422/200; 122/510; 122/511; 432/209

(58) Field of Classification Search ..... 422/198, 422/200; 202/124, 241, 222, 223; 122/510, 122/511; 432/209
See application file for complete search history.

(56) References Cited

U.S. PATENT DOCUMENTS

| | | | | |
|---|---|---|---|---|
| 4,986,222 | A * | 1/1991 | Pickell et al. | 122/6 R |
| 5,078,857 | A | 1/1992 | Melton | |
| 6,178,926 | B1 | 1/2001 | Worman | |
| 6,237,545 | B1 * | 5/2001 | Barnett et al. | 122/235.23 |
| 6,264,798 | B1 | 7/2001 | Gibson et al. | |

FOREIGN PATENT DOCUMENTS

BR PI 9707097-1 2/2000

* cited by examiner

*Primary Examiner*—N. Bhat
(74) *Attorney, Agent, or Firm*—Nixon & Vanderhye PC

(57) ABSTRACT

The present invention concerns a processing furnace used by the oil industry to heat feedstocks that are to be treated thermally, which is provided with bi-pivotal support columns to carry the radiation exchange tubes which form the coil of radiation exchange tubes. The support columns are provided with a lower bearing and an upper bearing means, which pivot, respectively, on a lower support and an upper guide, in such a way that all the stresses from the support and the radiation exchange tubes are transmitted to the base, causing no thermal stress from bending momentum to be transmitted to the base of the furnace.

17 Claims, 4 Drawing Sheets

DOUBLE-FIRED PROCESSING FURNACE

FIELD OF THE INVENTION

This invention relates to a processing furnace used by the oil industry to heat feedstocks that are to be treated thermally. More specifically, the present invention relates to a processing furnace that is fitted with a novel support system for coiled tubes which use bi-pivotal support columns.

RELATED ART

Furnaces form one of the main items of an industrial plant intended for coke-production by the known process of delayed coking. In these units, furnaces are used for heating the substance to be treated, also known as the feedstock.

The feedstock, initially encountered in its liquid state, is heated inside an assembly of tubes formed into a coil. During heating, part of the feedstock vaporises and, after a certain point, the process of thermal cracking of the feedstock begins. As a result of the thermal cracking, the chemical composition of the feedstock at the output is different from its composition at the time of input.

To prevent uncontrolled cracking, the amount of time the feedstock remains inside the furnace is controlled. Other variables are also controlled, such as the temperature and distribution of heat along the tubes. After leaving the furnace, the feedstock passes through a transfer line to the coke drums, where final processing of the product takes place.

In a design of furnace known to specialists as the "single-fired" type, widely used in the past, horizontal tubes subjected to single-source heating were deployed; that is to say, the burners were placed at only one side of the tubes.

Furnaces of the single-fired type are characterised by including a radiant heating chamber of prismatic appearance, and are generally fitted with two coils of horizontal tubes, placed close to the two walls of the radiant heating chamber. Above the radiant heating chamber, or radiation area, there is a space for the collection of gases, known as the convection area, where heating of the feedstock commences.

The tubes in the radiation area are heated by burners placed in a row along the central axis of the lower part of the chamber. The furnace walls are insulated with heat-resistant material.

The positioning of the coils close to the furnace walls allows tube supports to be projected out; these can be fixed to elements of the structure which make up the side walls of the radiant heating chamber. Supports are generally used that will carry from one to four tubes, and which are fixed to the furnace columns with bolts.

This type of pipework arrangement presents serious problems in operation: these problems are related to the non-uniform distribution of heat along the circumference of the tubes, since only one side is directly exposed to the source of heat, whereas the other side is turned towards the wall, control of the feedstock's heating conditions is more difficult.

As a result of the poor distribution of heat within the coil, there is a tendency for the tubes to deform and there is also a tendency for deposits of solids, known as coke, to form inside the tubes. By reducing the flow area in the tubes, the coke deposits result in an increase in the pressure drop inside the tube coil. Moreover, as the coke impairs the transfer of heat from the wall of the tube to the feedstock, there is an increase in temperature at the wall of the tube.

The thickness of the coke deposit increases gradually over time, until a critical point is reached at which its removal becomes essential. This operation is known as decoking. The time interval between two decoking operations is known as the service life. Since a decoking operation results in lost production, an increase in service life will increase the profitability of the plant.

No matter what the type of furnace, it may feature headers installed inside a casing (header box) for protection against direct heat radiation from the flames and from combustion gases. The headers may, if necessary, be positioned at either or both side ends of the coiled tubes.

The headers are intended to make it possible to perform inspection and cleaning operations, including decoking, inside the coiled tubes. Cleaning operations can be carried out with the help of compressed air or steam, or mechanically, since a certain amount of coke will always become stuck to the inside walls of the coiled tubes.

Another design of furnace known to specialists as the "double-fired" type was developed to eliminate the above-mentioned problems. The "double-fired" furnace features tubes subject to double-source heating.

Interconnected assemblies of horizontal tubes are used in these furnaces, in the shape of coils, placed away from the furnace walls, thus facilitating more uniform heating of the tubes. To carry out heating, rows of burners, interposed with the pipework, are used.

The advantages of this design can be highlighted as follows: better heat distribution throughout the length and circumference of the tubes; for the same average heat inside the radiation area, the film and wall temperatures in the radiant heating chamber are lower than those found in single-fired furnaces; less tendency for thermal deformation of the tubes in the radiant heating chamber to occur; and less coke formation, thus producing greater service life.

An important aspect of this type of furnace is the support system for the horizontal tubes that make up the coil of the radiation section. Support is provided by physical components, placed away from the furnace's heat-resistant walls, which are exposed to the direct action of the flames, at high temperatures, inside the furnace.

In addition, it is necessary to use a special method of calculation in order to ensure the appropriate physical and thermal dimensioning of all the components of the support system.

The features of the heating system described above are already well known to those with the relevant technical skills.

The furnace described in patent document U.S. Pat. No. 5,078,857 is intended for use in delayed-coking systems, in which coiled horizontal tubes with double heating are deployed. As described in column 3, lines 28 to 33 of U.S. Pat. No. 5,078,857, the tubes are suspended from the ceiling by intermediate supports. Since the weight of the coils and intermediate supports is carried by a structure installed on the ceiling of the furnace, both this structure as well as the remaining structures carrying the side radiation walls need to be able to support that weight.

The fact that the furnace tube supports in U.S. Pat. No. 5,078,857 are suspended means that thermal expansion resulting from its heating triggers significant vertical displacement down from the output nozzle (24). This displacement complicates the interconnections of the nozzle with piping to which it must be connected. This piping directs the feedstock towards the plant used later in the process. Thus, this piping must be sufficiently flexible to absorb these displacements without suffering excessive stresses, or causing excessive strain at the furnace's output nozzle (24).

Another shortcoming observed in the furnace of U.S. Pat. No. 5,078,857 concerns the design of the supports at the end of the pipework. These supports are made by installing a large number of plates, set one into another in a sliding manner; each plate supporting one or two tubes of the coil. This arrangement of the supports is aimed at absorbing their own thermal size variations, that is to say, expansion and contraction of the support/coil assembly, brought about by temperature changes.

Apart from the relative internal plate movements absorbing expansion of the supports, as well as vertical tube movements, this design is brittle when supporting the high stresses brought about by variations in size exerted on the plates. In expanding lengthwize, the tubes shift in relation to the plates. This movement causes increased frictional stress in the plates, which can cause them to buckle. If there is buckling of the plates, the entire system may jam.

U.S. Pat. No. 6,264,798 describes a furnace of the double-fired type, applied to delayed-coking treatment, in which the tubes are arranged in two adjoining rows. It is widely known among experts in this field that a tube arrangement of the sort presented in this patent results in erratic heat distribution compared with single-row furnaces. As mentioned in column 2, line 49, of this patent, a furnace with this layout requires 6.25% greater pipework area to reach the same capacity as a single-row furnace. A further disadvantage of the furnace in this patent is that the radiation area can only be fitted with one pair of rows of tubes.

U.S. Pat. No. 6,178,926 describes a double-fired furnace in which the tubes are arranged in a vertical row. The tube supports are hung from the ceiling and can be replaced either as a complete assembly with the coil or separately. As the weight of the coils and intermediate supports is borne by the structure in the furnace ceiling, the more both this structure as well as the structures carrying the side radiation walls need to be able to support that weight.

The fact that the furnace tubes in U.S. Pat. No. 6,178,926 are suspended means that the expansion brought about during heating causes a significant vertical displacement downwards of the output nozzle. This movement complicates the interconnection of that nozzle to the associated pipework. Also, it is only possible to deploy a single row of tubes in each radiant heating chamber.

In Brazilian patent application no. PI 9707097 in the name of the applicant of the present invention, a furnace is described in which the support system includes support columns to carry a pipework radiation exchange coil in a radiant heating chamber in which the lower ends of the support columns are secured rigidly onto the base of the furnace, and the upper ends rest pivoting on upper supports.

Using this support system, the burden of the weight from the coil of the radiation exchange tubes, and also of the support columns, is carried by the base of the furnace, and consequently a furnace is produced whose structural characteristics can be considerably less robust (and thus less expensive) than in previously-known furnaces. A drawback encountered with the support system of PI 9707097, however, is that thermal stress crush momentum is transmitted to the base of the furnace, thus requiring structural reinforcement at the base.

SUMMARY OF THE INVENTION

The furnace forming the subject of the present invention is fitted with a new support system, which addresses the above-mentioned problems.

It is desirable to produce a more efficient furnace for use in delayed-coking processes, to minimise the formation of coke inside the coiled tubes, thus allowing a longer service life.

It is also desirable to provide a furnace with a support system that includes support columns to carry the horizontal coiled pipework, with double heating, endowed with high strength and ability to absorb expansion of the various components of the furnace, thus minimising thermal deformation caused by temperature changes. In this way, movements of the nozzle(s) at the feedstock outputs are also minimised.

It is also desirable to provide a furnace with a support system that includes support columns for the horizontal coiled pipework that rest pivoting above the base of the furnace, so that no thermal bending moment is transmitted to the base of the furnace.

It is also desirable to provide a furnace with a support system that includes support columns for the horizontal coiled tubes that are supported and guided from the ceiling of the furnace in guides at the top in a manner that allows thermal expansion of support to be absorbed, so that the structure in the ceiling and the support structure for the side walls is not subject to any action from the weight of the tubes and the support.

It is further desirable to provide a more efficient furnace featuring a prismatic section, with one or more horizontal coils and burners on both sides, for use in industrial processes.

This invention concerns a processing furnace, primarily used by the oil industry to heat feedstocks that are to be treated thermally, and has a support to carry conduction tubes that will be subject to thermal stresses.

In one aspect, the invention comprises a processing furnace for thermally treating feedstocks, said furnace including: a ceiling and base; a radiant heating chamber, inside which there is a continuous coil of radiation exchange tubes for allowing said feedstock to follow a path back and forth inside the tubes in the radiant heating chamber; a main support, said main support supporting the radiation exchange tubes of the coil of radiation exchange tubes, and comprising an upper bearing and a lower bearing means; an upper guide fixed to the ceiling, to which the upper bearing of the main support is connected; a lower support secured to the base, to which the lower bearing of the main support is connected; said connections being such as to allow thermal expansion of said main support (4) without transmitting excessive stress to the ceiling.

In another aspect, the invention comprises a support column for use in carrying tubes inside a processing furnace for thermally treating feedstocks, said support column comprising: a support component extending longitudinally for supporting a plurality of tubes; an upper connecting component installed inside an upper housing positioned at the upper end of the support component, said upper connecting component presenting a generally arcuate surface for coupling to an upper guide means; and a lower connecting component installed inside a lower housing positioned at the lower end of the support component, said lower connecting component presenting a generally arcuate surface for coupling to a lower support.

In a first embodiment, this invention includes a processing furnace with double heating, to heat feedstocks that are to be treated thermally, which includes:

side walls, a ceiling and a base;

a convection chamber, inside which is found a plurality of convection exchange tubes, inside which the feedstock to be heated will circulate; the convection exchange tubes rest upon intermediate supports, mounted to the side walls of the convection chamber and are interconnected at their ends using return bends and/or headers, to form a continuous coil of pipework for exchange by convection, allowing the feedstock to follow a continuous path back and forth inside the convection chamber;

a radiant heating chamber, inside which are found a plurality of tubes for exchange by radiation, interconnected at their ends in pairs, using return bends and/or headers, to form a continuous coil of pipework for exchange by radiation, allowing the feedstock to follow a continuous path back and forth inside the radiant heating chamber;

a flexible pipe piece to interconnect the lower end of the coil of convection exchange tubes to the upper end of the coil of radiation exchange tubes;

an input nozzle, which is connected to the end of the first convection exchange tube in the coil of convection exchange tubes;

an output nozzle, which is connected to the last radiation exchange tube in the coil of radiation exchange tubes;

a plurality of main supports, each main support being provided with a plurality of holes to support the radiation exchange tubes in the coil of radiation exchange tubes, an upper bearing and a lower bearing means;

a plurality of upper guides mounted onto the ceiling, to which the upper bearing of each respective main support is connected. The processing furnace is also fitted with a plurality of lower supports mounted on the base, each lower support being provided with a housing for a bearing, and each lower bearing pivots on the bearing housing of the respective lower support, so that it is fitted with a pivotal connection between the main support and the lower support.

In a second embodiment, the invention concerns a support column to support the conduction tubes subject to thermal stresses, which includes:

a support component which extends longitudinally;

lateral reinforcements;

an upper connecting component which is installed inside a pair of upper housing units, which are fixed to the upper end of the support and aligned longitudinally and spaced out in such a way that the two end sections of the upper connecting component remain resting on the upper housing units; however, a central section of the upper connecting component remains free, so that it can rest upon any upper bearing element;

a lower connecting component which is installed inside one of the lower housing units, which are secured to the lower end of the support and aligned longitudinally and spaced out in such a way that the two end sections of the lower connecting component will remain resting on the lower housing units; however, a central section of the lower connecting component will remain free, so that it can rest on any lower bearing element.

BRIEF DESCRIPTION OF THE DRAWINGS

The present invention will now be described, by way of example only, with reference to the accompanying schematic drawings, in which.

DETAILED DESCRIPTION OF THE INVENTION

Figure 1:
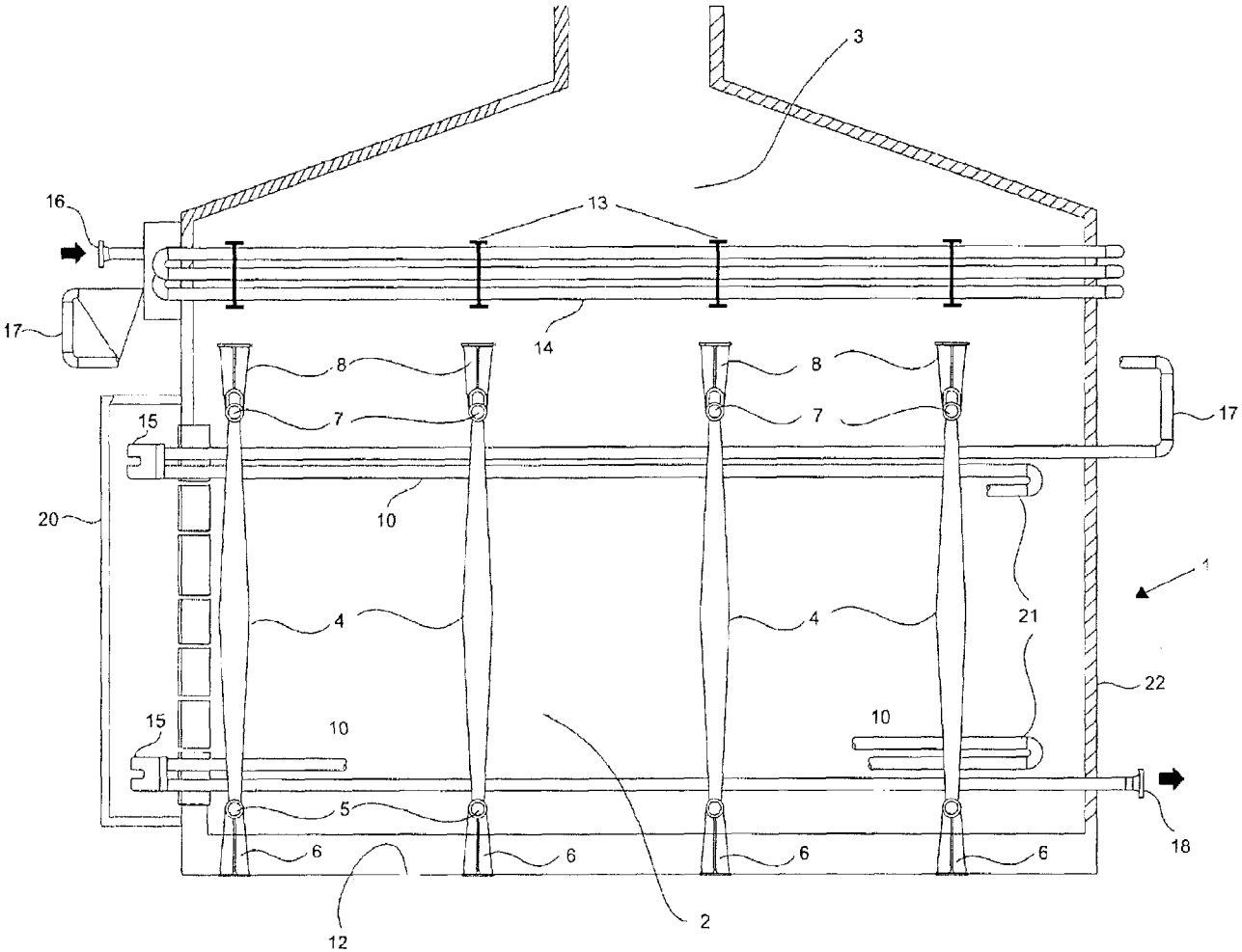
FIG. 1 is a view in longitudinal cross-section of the furnace of the present invention.

FIG. 1 depicts a longitudinal view of the furnace (1) forming the subject of the invention, including a radiant heating chamber (2) and a convection chamber or area (3).

Inside the radiant heating chamber (2) there is a plurality of supports (4), also called support columns, to carry the radiation exchange tubes (10), arranged essentially horizontally in the longitudinal direction, such supports forming part of the support system of the present invention. The supports (4) rest on the base (12) of the furnace (1).

The radiation exchange tubes (10) are interconnected at their ends in pairs, using return bends (21) and/or headers (15), to form a continuous tube, known as a coil of radiation exchange pipework, inside which flows the feedstock to be heated. In this way the coil of radiation exchange tubes allows the feedstock to follow a continuous path back and forth inside the radiant heating chamber (2).

In FIG. 1, only some of the radiation exchange tubes (10) are shown in the interests of clarity and simplicity, but it should be understood that these radiation exchange tubes (10) are normally distributed throughout the available length of the furnace, to form the coil system of radiation exchange tubes as mentioned above.

Figure 2:
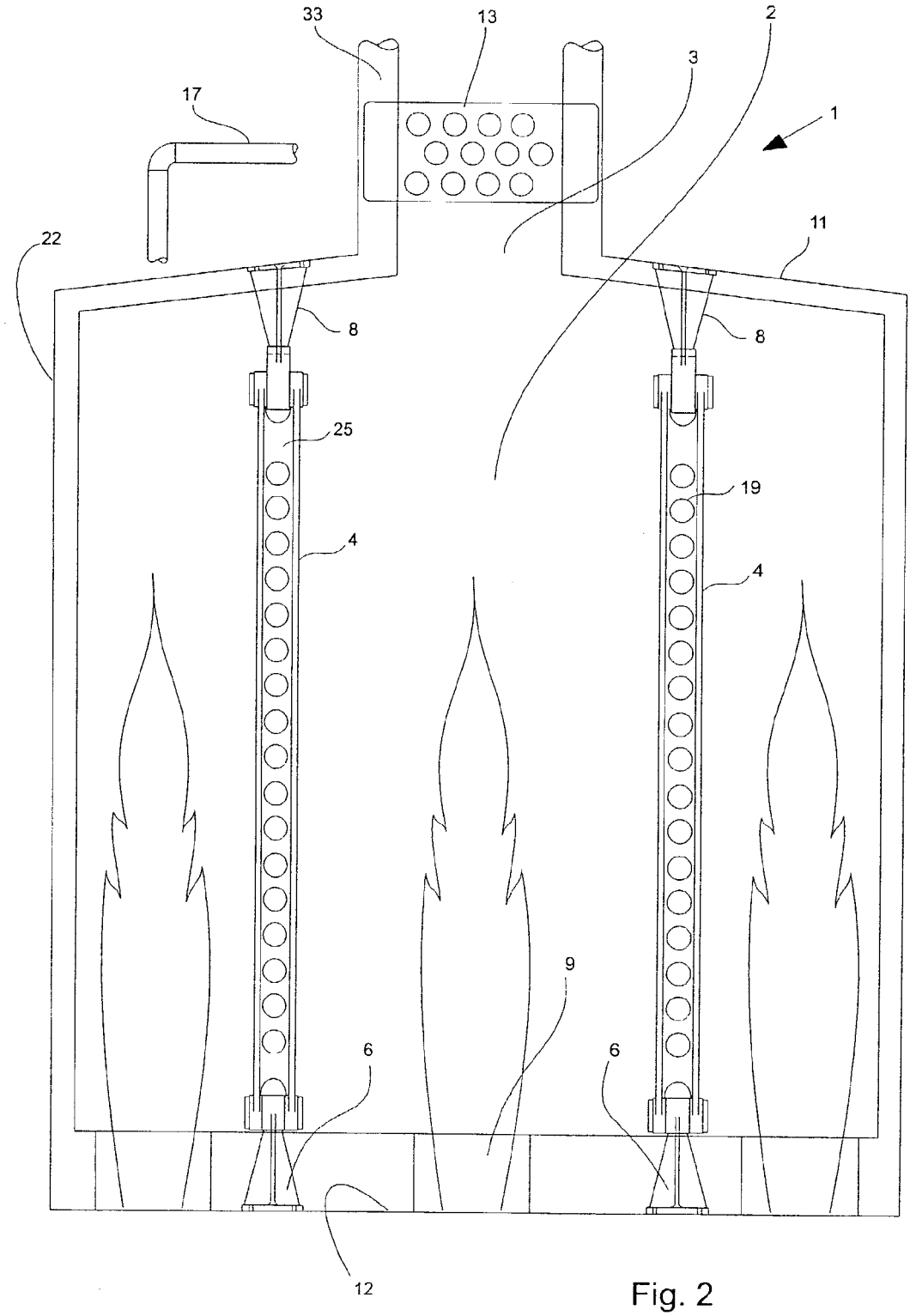
FIG. 2 is a view in transverse cross-section of the furnace of the present invention.

The furnace can be built with one or more radiation coils, which in that case are mounted alternately with rows of burners (9), as can be seen in FIG. 2, so that each coil of radiation exchange tubes will receive heat on both sides. Furnaces in which the tubes receive heat on both sides are classified as double fired, even though there may be more than two rows of burners (9) involved.

The burners (9) are generally arranged in rows, and the number of rows is equal to the number of coils of radiation exchange tubes (10) plus one. In FIG. 2, by way of example we show a transverse section of a furnace with two radiation coils and three rows of burners (9).

At this point it should be mentioned that the number of radiation exchange coils (10) to be deployed is not restricted to the numbers mentioned above, for it is possible to use any number of coils, to be determined as a function of the features of a particular project.

Above the radiant heating chamber (2) is found the convection chamber (3), which includes a case, normally prismatic, in which convection exchange tubes (14) are mounted. The convection exchange tubes (14) are carried upon intermediate tube supports (13) which are mounted onto the side wall structure (33) of the convection chamber (3), as depicted in FIG. 2, in accordance with known techniques.

The convection exchange tubes (14) are interconnected at their ends using return bends and/or headers, using known techniques, so as to form a continuous tube, known as a coil of convection exchange tubes, inside which the feedstock to be heated will flow. In this way, the coil of convection exchange tubes allow the feedstock to follow a continuous path back and forth inside the convection chamber (3).

A flexible pipe piece (17) interconnects the lower end of the coil of convection exchange tubes to the upper end of the coil of radiation exchange tubes. The pliable tube piece (17) compensates for the variations in size undergone by the coils formed by the convection exchange tubes (14), also by the radiation exchange tubes (10) and their supports (4), depending on the temperature variations inside the furnace.

The feedstock to be treated enters the furnace (1) through an input nozzle (16) which is connected to the end of the first convection exchange tube (14) of the coil of convection exchange tubes; in this way, the feedstock can then flow through the coil of convection exchange tubes. Upon leaving the final convection exchange tube (14) of the coil of convection exchange tubes, the feedstock passes through the flexible pipe piece (17) and enters the first radiation exchange_tube (10) of the coil of radiation exchange tubes.

The feedstock thus passes into the coil of radiation exchange tubes and leaves the furnace (1) upon completion of treatment inside the furnace through an output nozzle (18) at the lower part of the radiant heating chamber (2) which is connected to the final radiation exchange tube (10) of the coil of radiation exchange tubes.

As already mentioned, one can use headers (15) to join one or both ends of the radiation exchange tubes (10) and the convection exchange tubes (14). These headers (15) have the function of facilitating internal inspections and cleaning of the tubes. The headers (15) are normally mounted inside a header box (20), protected from direct radiation from the burners' flames (9), and from combustion gases.

Figure 3:
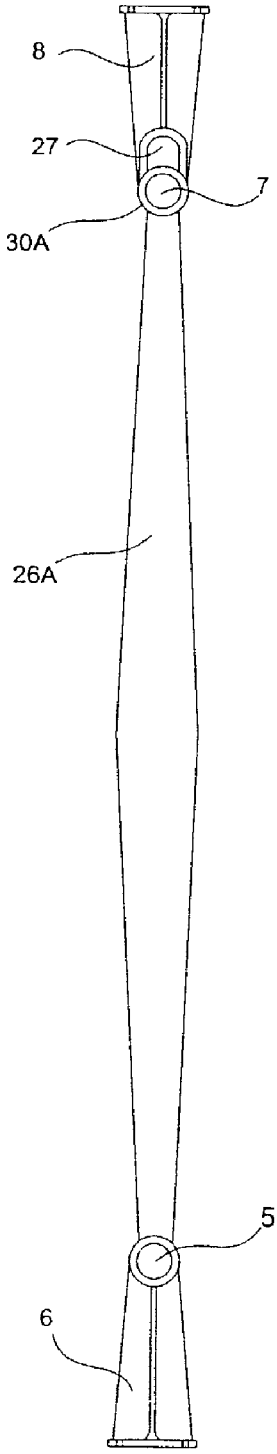
FIG. 3 is a side view of a pipework support used in the furnace of the present invention.
Figure 4:
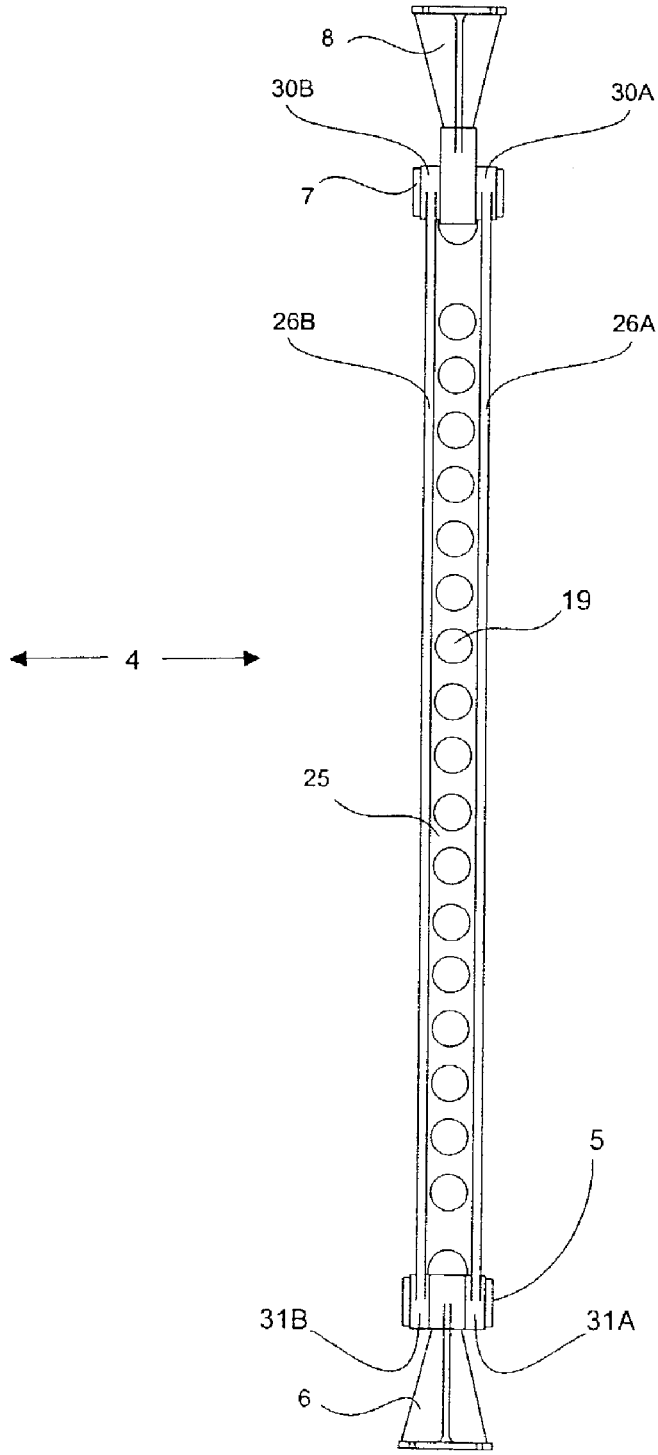
FIG. 4 is a front view of a pipework support used in the furnace of the present invention.

FIGS. 3 and 4 depict, respectively, a side and a front view of the supports (4). In these illustrations, the coils of radiation exchange tubes (10) and coils of convection exchange tubes (14) are not shown, in the interests of clarity and simplicity.

The supports (4) include a support component (25) which extends vertically, and lateral reinforcements (26A) and (26B), both of these components being manufactured from materials with high physical strength and increased resistance to the effects of high temperatures within the radiation area.

The support component (25) is provided with holes (19) and the radiation exchange tubes (10) pass through these holes (19) in such a way that they rest across the whole contact area of the orbital surface of the sides of the holes (19). In other words, the radiation exchange tubes (10) rest upon a substantial portion of the area of the cylindrical segment at the side of the holes.

The holes (19) have a diameter slightly greater than the outside diameter of the radiation exchange tubes (10), so that they can absorb thermal expansion of the radiation exchange tubes (10) and also of their own supports (4), without being subjected to excessive stresses.

Thus, the size of the holes (19) will depend upon factors that vary with each particular project and the way the furnace is constructed, such as the material used to manufacture the radiation exchange tubes (10), the material used for the supports (4), operating temperatures, etc.

The main supports (4) rest upon lower supports (6) which themselves rest upon the base (12) of the furnace (1).

Figure 6:
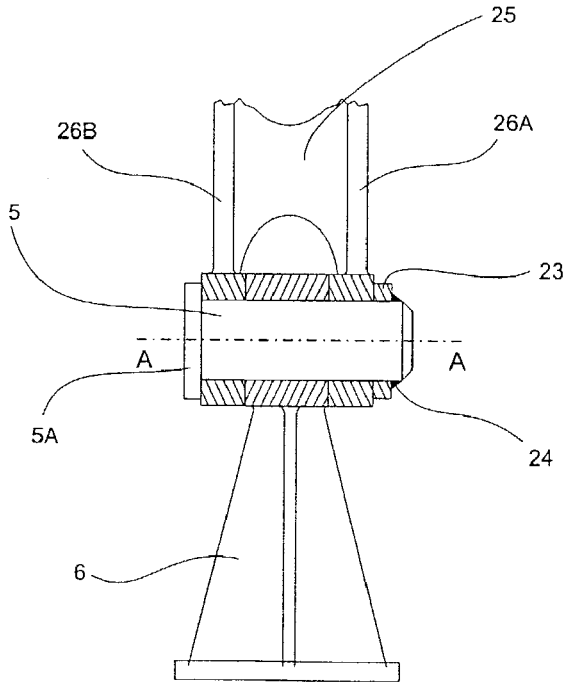
FIG. 6 is a detail of the lower end of a pipework support.

FIG. 6 shows, in cross-section, the linking area between a main support (4) and a lower support (6).

The lower end of the support (4) is provided with a pair of lower housings (31A) and (31B) which are fixed, respectively, to lateral reinforcements (26A) and (26B). The main body of each of the lower housings (31A) and (31B) includes a cylindrical segment, inside which a lower linking component (5) is installed, which includes an elongated body and functions in the manner of a pin.

The lower linking component (5) is provided at one end with a lower catch component (5A) which resembles a flange. To prevent the lower linking component (5) from being axially displaced a long axis A—A, a lower securing component (23)—an anchor ring in the current embodiment—is secured to the other end of the lower linking component (5).

In the current embodiment, the join between the lower linking component (5) and the lower securing component (23) is made using a weld seam (24). However, any other suitable securing method may be used to fulfil this function, for example a split pin, nut, etc.

The lower housings (31A) and (31B) are longitudinally aligned and spaced apart in such a way that the two end sections of the lower linking component (5) remain resting on the lower housings (31A) and (31B); however, a central section of the lower linking component (5) remains free.

This central section of the lower linking component (5) is inserted into a bearing housing (32) of the lower support (6). Thus, the assembly formed from the lower housings (31A) and (31B) and the lower linking component (5) form a lower bearing for the support (4), which pivots using the lower support (6), in such a way that it is provided with a pivoting link between the main support (4) and the lower support (6), as can be seen in the cross-section view in FIG. 6.

This connection is built in such a way that the lower end of support (4) can rotate freely on a longitudinal axis A—A of the lower connecting component (5). In this way, all the weight stress on the support (4) and on the radiation exchange tubes (10) is transmitted to the lower connecting component (5) which, in turn, transmits the stress to the lower support (6). Since the lower support (6) is secured to the base (12) of the furnace (1), the stress is thus transmitted to the base (12) of the furnace (1).

In this way, the entire weight of the coil of radiation exchange tubes and supports (4) is transmitted to the structural components that make up the base (12) of the furnace (1).

The upper end of the support (4) is provided with a pair of upper housings (30A) and (30B), which are fixed, respectively, to the lateral reinforcements (26A) and (26B). The body of each of the upper housings (30A) and (30B) includes a cylindrical segment, inside which an upper connecting component (7) is installed, which includes an elongated body which is similar to lower connecting component (5).

The upper connecting component (7) is provided at one end with an upper catch (7A) which resembles a flange. To prevent the upper connecting component (7) from being able to move axially along axis B—B, an upper fixing component (28), an anchor ring in the present embodiment, is secured to the other end of the upper connecting component (7).

In the present embodiment, the join between the upper connecting component (7) and the upper fixing component (28) is made by means of a weld seam (29). However, any other method of securing may be used that will fulfil this function, for example a split-pin, nut, etc.

The upper housings (30A) and (30B) are longitudinally aligned and spaced apart in such a way that the upper connecting component (7) will remain resting at both ends upon the upper housings (30A) and (30B); however, a central section of its length remains free.

Figure 5:
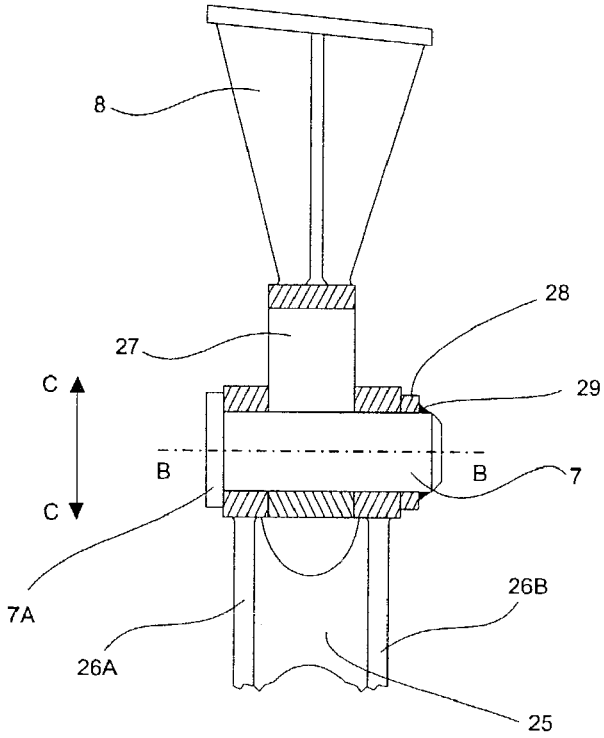
FIG. 5 is a detail of the upper end of a pipework support.

This central section, free of the upper connecting component (7) is inserted into an elongated hole (27) by an upper guide (8), as can be seen in FIGS. 3 and 5. Thus, the assembly formed by the upper housings (30A) and (30B) and the upper connecting component (7) form an upper bearing for support (4), which pivots and slides along the upper guide (8) in such away that a link is provided between the support (4) and the upper guide (8), as can be seen in cross-section in FIG. 5.

This connection is built in such a way that the upper end of support (4) can rotate freely on axis B—B of the upper connecting component (7), and can also move vertically along the oblong hole (27) by using the upper guide (8) in the directions indicated by the arrow C—C.

By permitting these rotating and linear movements of the upper end of the support (4), the upper guide (8) absorbs the thermal expansion of the support (4), but without causing any excessive stress to its own upper guide (8), to the support (4) or to the radiation exchange tubes (10). The upper guide (8) is mounted onto the ceiling (11) of the furnace (1) using any suitable known securing technique.

In this way, the assembly formed by the upper housings (30A) and (30B) and the upper connecting component (7) forms an upper bearing for the support (4).

As a result of the use of the supports (4) deployed to support the coil of radiation exchange tubes in the furnace (1) forming the subject of this invention, the output nozzle (18), placed at the lower part of the radiant heating chamber (2), remains practically motionless throughout operation of the furnace (1).

As a result of the longitudinal expansion of the supports (4), the upper radiation exchange tube (10) of the coil of radiation exchange tubes is displaced upwards. This movement, as well as movements resulting from expansion of the radiation exchange tubes (10) and the convection exchange tubes (14), are all absorbed by the flexible pipe piece (17).

There is no restriction on the height of the furnace when using supports (4), just as there is no limit on the number of radiation exchange tubes (10), and these may be of any diameter. The base (12), the side walls (22) and ceiling (11) of the furnace (1) are in this embodiment manufactured using materials that have the requisite physical durability, and coated with heat-resistant material.

The number of supports (4) to be deployed will depend on the available length of the furnace (1) and the diameter of the radiation exchange tubes (10).

Due to its unusual configuration, the lower supports (6) and upper guide (8) make it possible to use high-strength supports (4) of relatively slender dimensions, without any height restrictions, and whose linear expansion will not cause any excessive stress on the ceiling (11) or the base (12) of the furnace (1) when in operation.

By using the support system of the present invention, in which the main supports (4) rest upon lower supports (6), the greater part of the burden is transmitted to the base (12), as already mentioned.

Furthermore, since the transmission of stress from the supports (4) that rest upon lower supports (6) is made by pivoting, in other words not rigidly, there is no transmission of thermal stress by bending moment to the base (12) of the furnace (1). Hence it is not necessary for the base structure (12) to be reinforced, and as a result, a base (12) can be provided with a far less robust construction than usual.

Thus, the upper guide (8) receive no vertical stress, hence their function is essentially to serve as a lateral bearing for the supports (4), also to absorb thermal expansion of the supports (4). As a result, the ceiling (11) and side walls (22) of the furnace (1) can also be less robust. In this way, additional expense on reinforcing the structure of these parts is avoided.

In addition, due to the innovative features, the main supports (4), lower supports (6) and upper guide (8) are provided with greater resistance to horizontal stresses caused by friction from the radiation exchange tubes (10) that pass through the holes (19).

The invention has been described here with reference to a preferred embodiment which should not be considered as limiting the invention. The person skilled in the art will immediately spot amendments and substitutions that might be made, without altering the basic concept of the invention as described here.

For example, simple mechanical inversions may be carried out such as mounting main support (4) to the central part of pins (5) and (7) and mounting lower support (6) and upper guide (8) to the outside parts of pins (5) and (7). Further, elongated hole (27) may be provided on the main support mans (4) rather than upper guide (8), for example.

It should also be mentioned that, although the invention has been described here in relation to a furnace applied to coking processes, it is in no way restricted to this type of application; it might be applied to any type of furnace where there is a need to use support systems for pipework in thermal exchange.

The invention claimed is:

1. A double-fired processing furnace for thermally treating feedstocks, said furnace including:

a ceiling and base;

a radiant heating chamber, inside which there is a continuous coil of radiation exchange tubes for allowing said feedstock to follow a path back and forth inside the tubes in the radiant heating chamber;

a main support, said main support supporting the radiation exchange tubes of the coil of radiation exchange tubes, and comprising an upper bearing and a lower bearing means;

an upper guide fixed to the ceiling, to which the upper bearing of the main support is connected; and a lower support secured to the base, to which the lower bearing of the main support is connected;

wherein said connections allow thermal expansion of said main support without transmitting excessive stress to the ceiling.

2. A furnace according to claim 1, wherein said lower bearing of said main support is pivotable with respect to the lower support to which it is connected.

3. A furnace according to claim 2, wherein said upper bearing of said main support is pivotable with respect to the upper guide to which it is connected.

4. A furnace according to claim 3, wherein said upper bearing of said main support is translatable in the generally vertical direction with respect to the upper guide to which it is connected.

5. A furnace according to claim 4, wherein said upper bearing is translatable with respect to the upper guide (8) by the use of a generally vertically directed elongate hole (27).

6. A furnace according to claim 5, wherein said elongate hole forms part of said upper guide and said upper bearing further comprises an upper connecting component installed in an upper housing of said main support, said upper connecting component being inserted into said elongate hole for movement therein in the generally vertical direction.

7. A furnace according to claim 6, wherein said lower support comprises a housing and said lower bearing further comprises a lower connecting component installed in a lower housing of said main support, said lower connecting component being inserted into said housing to enable pivotal movement of said main support relative to said lower support.

8. A furnace according to claim 7, further comprising a catch and a securing ring provided at opposite ends of said connecting component to prevent longitudinal movement of said connecting component along its longitudinal axis.

9. A furnace according to claim 8, wherein said main support comprises lateral reinforcement for strengthening the main support against buckling due to compression applied generally vertically.

10. A furnace according to claim 9, wherein said main support comprises a plurality of holes to support the radiation exchange tubes of the coil of radiation exchange tubes.

11. A furnace according to claim 10, wherein a plurality of main supports, lower supports and upper guides are provided to support the radiation exchange tubes in the radiant heating chamber.

12. A furnace according to claim 11, further comprising:

a convection chamber, inside which a number of convection exchange tubes are installed, inside which the feedstock to be heated can flow, the convection exchange tubes resting upon intermediate bearings fixed to a side wall structure of the convection chamber to form a continuous coil of convection exchange tubes, allowing the feedstock to follow a continuous path back and forth inside the convection chamber.

13. A furnace according to claim 12, further comprising:

a flexible pipe piece to interconnect the lower end of the coil of convection exchange tubes to the upper end of the coil of radiation exchange tubes;

an input nozzle to which the end of the first convection exchange tube of the coil of convection exchange tubes is connected;

an output nozzle to which the last radiation exchange tube of the coil of radiation exchange tubes is connected.

14. A support column for use in carrying tubes inside a processing furnace for thermally treating feedstocks, said support column comprising:

a support component extending longitudinally for supporting a plurality of tubes;

an upper connecting component installed inside an upper housing positioned at the upper end of the support component, said upper connecting component presenting a generally arcuate surface for coupling to an upper guide means; and a lower connecting component installed inside a lower housing positioned at the lower end of the support component, said lower connecting component presenting a generally arcuate surface for coupling to a lower support said support column further comprising a lower support having a housing into which the generally arcuate surface of said lower connecting component is inserted so that said lower support may pivot with respect to the main support.

15. A support column according to claim 14, further comprising an upper guide having an elongate hole into which the generally arcuate surface of said upper connecting component is inserted so that said upper guide may pivot and translate with respect to said main support.

16. A support column according to claim 14, further comprising lateral reinforcement means.

17. A system for coke production, including:

a double-fired processing furnace for thermally treating feedstocks, wherein the double-fired furnace comprises:

a ceiling and base;

a radiant heating chamber, inside which there is a continuous coil of radiation exchange tubes for allowing said feedstock to follow a path back and forth inside the tubes in the radiant heating chamber;

a main support, said main support supporting the radiation exchange tubes of the coil of radiation exchange tubes, and comprising an upper bearing and a lower bearing means;

an upper guide fixed to the ceiling, to which the upper bearing of the main support is connected; and a lower support secured to the base, to which the lower bearing of the main support is connected;

wherein said connections allow thermal expansion of said main support without transmitting excessive stress to the ceiling.

* * * * *